US009456664B2

(12) United States Patent
Tanaka

(10) Patent No.: US 9,456,664 B2
(45) Date of Patent: Oct. 4, 2016

(54) METHOD FOR FORMING STOPPER

(75) Inventor: Ryo Tanaka, Toyama (JP)

(73) Assignee: YKK Corporation (JP)

( * ) Notice: Subject to any disclaimer, the term of this patent is extended or adjusted under 35 U.S.C. 154(b) by 95 days.

(21) Appl. No.: 14/111,244

(22) PCT Filed: May 24, 2011

(86) PCT No.: PCT/JP2011/061801

§ 371 (c)(1),
(2), (4) Date: Oct. 11, 2013

(87) PCT Pub. No.: WO2012/160643

PCT Pub. Date: Nov. 29, 2012

(65) Prior Publication Data

US 2014/0033483 A1 Feb. 6, 2014

(51) Int. Cl.

| | |
|---|---|
| ***A44B 19/32*** | (2006.01) |
| ***A44B 19/60*** | (2006.01) |
| ***A44B 19/36*** | (2006.01) |
| ***A44B 19/04*** | (2006.01) |

(52) U.S. Cl.

CPC ..... *A44B 19/60* (2013.01); *A44B 19/04* (2013.01); *A44B 19/32* (2013.01); *A44B 19/36* (2013.01); *Y10T 24/2539* (2015.01)

(58) Field of Classification Search

CPC .. Y10T 24/2539; A44B 19/32; A44B 19/04; A44B 19/60

See application file for complete search history.

(56) References Cited

U.S. PATENT DOCUMENTS 3,895,418 A * 7/1975 Ebata ..... 24/435
4,782,563 A * 11/1988 Kusayama ..... 24/435
2001/0047574 A1* 12/2001 Matsushima et al. ..... 24/433
2003/0000049 A1 1/2003 Ichikawa
2003/0098331 A1* 5/2003 Nakata ..... B29C 65/04 228/103
2003/0115724 A1* 6/2003 Takazawa ..... A44B 19/388 24/388
2004/0211041 A1* 10/2004 Morioka et al. ..... 24/389

FOREIGN PATENT DOCUMENTS

| | | | |
|---|---|---|---|
| CN | 1325657 | A | 12/2001 |
| CN | 1391860 | A | 1/2003 |
| CN | 1541588 | A | 11/2004 |
| EP | 1269878 | A2 | 1/2003 |
| HK | 1040890 | A1 | 9/2005 |

(Continued)

OTHER PUBLICATIONS

International Search Report, PCT Application No. PCT/JP2011/061801 mailed Jul. 5, 2011.

*Primary Examiner* — Daniel McNally
(74) *Attorney, Agent, or Firm* — Kilpatrick Townsend & Stockton LLP

(57) ABSTRACT

The method for forming a stopper includes injection molding a stopper molding comprising a molding body portion which embeds an end portion of an element row, and a thin fin portion which extends outward from a periphery portion of the molding body portion on at least one end portion side of the element row, and forming a high frequency wave adhesion portion by adhering the fin portion of the stopper molding by a high frequency wave. By this, a fixing strength of the stopper can be increased, and the high frequency wave adhesion portion can be configured to bend easily by making a thickness of the high frequency wave adhesion portion thin, thereby stably forming the stopper which is difficult to detach for a long period of time.

4 Claims, 9 Drawing Sheets

(56) References Cited

FOREIGN PATENT DOCUMENTS

| | | | |
|---|---|---|---|
| JP | 4-36657 | Y2 | 8/1992 |
| JP | 2001-340112 | A | 12/2001 |
| JP | 2003-309 | A | 1/2003 |
| JP | 2004-189282 | A | 7/2004 |
| JP | 2004-321547 | A | 11/2004 |
| KR | 20020096914 | A | 12/2002 |
| KR | 20040092495 | A | 11/2004 |
| TW | 523399 | B | 3/2003 |

* cited by examiner

METHOD FOR FORMING STOPPER

This application is a national stage application of PCT/JP2011/061801 which is incorporated herein by reference.

TECHNICAL FIELD

The present invention relates to a method for forming a stopper of an airtight and waterproof slide fastener which is applied to a flexible container used for liquid transportation and such, or to special working clothes such as protective clothing and diving gear, and the airtight and waterproof slide fastener comprising the stopper.

BACKGROUND ART

Conventionally, an airtight and waterproof slide fastener is used for an opening and closing portion of a flexible container used for liquid transportation or an opening portion of special working clothes to ensure airtightness and waterproof property even under severe environments such as high pressure or high temperature and humidity. An example of such airtight and waterproof slide fastener is disclosed in, for example, JP UM 04-36657 B (Patent Document 1) and JP 2003-000309 A (Patent Document 2).

For example, the airtight and waterproof slide fastener 70 shown in Patent Document 1 comprises, as shown in FIG. 14, first and second fastener stringers 71a, 71b in which a plurality of fastener elements 73 are attached to facing tape side edge portions 72a of a pair of airtight and waterproof tapes 72, a backing tape piece 74 fixed so as to stride across the pair of airtight and waterproof tapes 72 at one end portion of the first and second fastener stringers 71a, 71b, a slider 75 slidably disposed along an element row comprised of the plurality of fastener elements 73, and a stopper (lower stopper) disposed at least at one end portion of the element row.

The airtight and waterproof tape 72a maintains its waterproof property by forming an airtight and waterproof layer on a tape front surface (first tape surface) of the fastener tape by rubberizing and such the fastener tape. The plurality of fastener elements 73 are attached to the tape side edge portion 72a of the airtight and waterproof tape 72, and each fastener element 73 has a spear-shaped coupling element comprising a coupling head portion at its forefront, and a clamp element with a U shape cross-section.

In this case, the tape side edge portion 72 of the airtight and waterproof tape 72 is bent in an Ω shape so as to embrace a base end portion of the coupling element in a state where the coupling head portion of the coupling element protrudes outwards. Further, the clamp element of the fastener element 73 is fixed on an outside of the Ω-shaped tape portion, the clamp element is swaged toward an inside, and the base end portion of the coupling element and the Ω-shaped tape portion are solidly sandwiched and fixed in the clamp element. By this, the fastener elements 73 are attached to the tape side edge portion 72a of the airtight and waterproof tape 72 with a required interval.

The backing tape piece 74 is adhered to a tape rear surface (second tape surface) side of the airtight and waterproof tape 72 of the first and second fastener stringers 71a, 71b.

The slider 75 of Patent Document 1 comprises a slider body 75a, a tab 75c holding protrusion 75b provided in a protruded manner in a tape width direction from a side surface of the slider body 75a, and a tab 75c held rotatably on the tab 75c holding protrusion 75b. A substantially Y-shaped guide hole which guides the fastener element 73 and the tape side edge portion 72a is provided inside the slider body 75a.

The stopper 76 is disposed on one end portion of the element row to prevent the slider 75 from dropping off from the element row. This stopper 76 comprises a block-shaped body portion 76a disposed so as to cover several fastener elements 73 and the bent tape side edge portion 72a, and a thin fin portion 76b disposed on an base end portion periphery (bottom end portion periphery) of the fastener tape side of the body portion 76a. And the stopper 76 is fixed at a bottom surface of the body portion 76a and the fin portion 76b so as to stride across the airtight and waterproof tape 72 and the backing tape piece 74, by injection molding.

Particularly, in the stopper 76 of Patent Document 1, a notch-shaped space portion 76c is formed on a bottom end portion of a contacting side surface to which the slider 75 of the body portion 76a contacts, and the fin portion 76b which is disposed on the slider 75 contacting side surface side of the body portion 76a is provided in a size to be accommodated inside the space portion 76c. That is, a forefront of the fin portion 76b disposed on the slider 75 contacting side surface side is positioned inward than the position of the slider 75 contacting side surface of the body portion 76a.

In the airtight and waterproof slide fastener 70 of Patent Document 1 comprising the above configuration, since the fin portion 76b of the slider 75 contacting side surface side of the stopper 76 is accommodated in the space portion 76c of the body portion 76a, even when the slider 75 strongly collides with the stopper 76, the slider 75 does not contact the fin portion 76b of the stopper 76. By this, when the slider 75 strongly collides with the stopper 76 repeatedly during a long period of use of the airtight and waterproof slide fastener 70, the fin portion 76b of the slider 75 contacting side surface side can be prevented from detaching due to collision of the slider 75.

On the other hand, in such airtight and waterproof slide fastener 70 of Patent Document 1, when for example it is bent or folded at a periphery portion of the stopper 76, it deforms so as to curve centering around a boundary portion of the body portion 76a and the fin portion 76b of the stopper 76, and can easily be bent. In this case, the fin portion 76b of the stopper 76 is bent at a sharp angle accompanying the curvature of the airtight and waterproof tape 72 and the backing tape piece 74, while a stress (force of restitution) to return to the original state between the body portion 76a directly acts on the fin portion 76b.

Because of this, when the airtight and waterproof slide fastener 70 is repeatedly bent or folded, there were cases where the fin portion 76b detaches from the bending airtight and waterproof tape 72 or the backing tape piece 74 due to action of the force of restitution, and it decreases or loses airtightness or waterproof property of the slide fastener.

With respect to the above problem of detaching of the fin portion, for example Patent Document 2 discloses an airtight and waterproof slide fastener in which a portion of a periphery portion of a fin portion disposed on a stopper comprises an extension which is adhered and fixed to an opening and closing end portion of a product to which a fastener is attached to which the airtight and waterproof slide fastener is attached.

To describe in detail referring to FIG. 15, the stopper 86 disposed on the airtight and waterproof slide fastener 80 of Patent Document 2 is fixed to stride across an airtight and waterproof tape 82 and a backing tape piece 84 by injection molding. And this stopper 86 comprises a substantially cubic-shape body portion 86a, and a fin portion 86b disposed on a lower end portion periphery of the body portion 86a. In this case, a thickness (dimension in a tape front and back direction) of the fin portion 86b is set to be 1.2 mm or more (the thickness of the fin portion 86b is set to 1.5 mm in the embodiment of Patent Document 2).

Also, the fin portion 86b is configured to have a size which extends outward than a position of an opening and closing end portion 88a of the product to which a fastener is attached 88 which is attached to the airtight and waterproof tape 82, shown by a two-dot chain line. By this, the fin portion 86b ensures a substantive fixing area with respect to the airtight and waterproof tape 82 or the backing tape piece 84, and increases the fixing strength of the stopper 86 (particularly the fin portion 86b).

Further, in Patent Document 2, by overlapping and adhesion integrating the opening and closing end portion 88a of the product to which a fastener is attached 88 on an upper surface of the fin portion 86b of the stopper 86 and an upper surface side of the airtight and waterproof tape 82, fixing of the fin portion 86b and the airtight and waterproof tape 82 is further strengthened.

In such airtight and waterproof slide fastener 80 of Patent Document 2, even when for example it is bent or folded at a periphery portion of the stopper 86, since the fin portion 86b is pressed from the upper surface side by the opening and closing end portion 88a of the product to which a fastener is attached 88 which overlaps on the fin portion 86b of the stopper 86, the fin portion 86b can be prevented from easily detaching from the airtight and waterproof tape 82 or the backing tape piece 84.

PRIOR ART DOCUMENT

Patent Document

Patent Document 1: JP UM 04-36657 B
Patent Document 2: JP 2003-000309 A

SUMMARY OF THE INVENTION

Problem to be Solved by the Invention

In the airtight and waterproof slide fastener 70, 80 according to Patent Document 1 and Patent Document 2, the stopper 76, 86 were fixed to the airtight and waterproof tape 72, 82 and the backing tape piece 74, 84 by using heat at a time of injection molding the stopper 76, 86 made of thermoplastic synthetic resin. Further, in the airtight and waterproof slide fastener 80 of Patent Document 2, to increase a fixing strength of the stopper 86, the fin portion 86b of the stopper 86 is configured by comprising an adequate extension to be adhered and fixed to the opening and closing end portion 88a of the attached product as described above.

However, when fixing the stopper 76, 86 by using heat at the time of injection molding, since the fin portion 76b, 86b of the stopper 76, 86 is formed to be thin, and the fin portion 76b, 86b is most of the time disposed far from a gate, heat at the time of injection molding at the fin portion 76b, 86b (particularly a forefront portion of the fin portion 76b, 86b) becomes lower compared to the body portion 76a, 86a of the stopper 76, 86, and the fixing strength equivalent to the body portion 76a, 86a could not be obtained. Therefore, even when the size of the fin portion 86b is increased as in Patent Document 2, it has been difficult to prevent detaching of the fin portion 86a at its forefront portion with certainty. Further, in recent years, the required quality towards the airtight and waterproof slide fastener is becoming strict more then ever, and further increase in the fixing strength of the stopper is being required.

With regard to the fixing strength of such stopper, in the conventional airtight and waterproof slide fastener, it has been considered to prevent detachment of the stopper by for example applying an adhesive agent to a surface of the airtight and waterproof tape and the backing tape piece, then injection molding the stopper on an upper surface of an adhesive layer of the adhesive agent to increase the fixing strength of the stopper more than in the case of Patent Document 1 and Patent Document 2.

However, when the stopper is injection molded through the adhesive layer in this way, when the airtight and waterproof slide fastener is used under severe environments such as high pressure and high temperature and humidity, since the adhesive layer deteriorates over time, high fixing strength of the stopper could not be stably maintained for a long period, and there was a concern that the stoppers would detach after a certain period of time had passed.

Also, when injection molding the stopper through the adhesive layer, since it is necessary to apply the adhesive agent to the airtight and waterproof tape and the backing tape piece and let it to dry before the injection molding process, the operation process required to form the stopper becomes complex, and a time to dry the adhesive agent has to be ensured. As a result, there has been a problem that the productivity of the airtight and waterproof slide fastener decreases and it leads to cost increase.

The present invention has been made in view of the above conventional problem, and its concrete objective is to provide a method of efficiently forming a stopper in which the fixing strength of the stopper is increased, and in which the stopper can be prevented from detaching for a long period of time, and to provide an airtight and waterproof slide fastener comprising such stopper.

Means for Solving the Problems

To achieve the above objective, a most significant feature of a method for forming a stop provided by the present invention comprises, as a basic configuration, a method for forming a stopper wherein a thermoplastic elastomer stopper which is disposed on at least one end portion side of an element row to stride across an airtight and waterproof tape and a backing tape piece, with respect to a pair of first and second fastener stringers wherein a plurality of fastener elements are attached to facing tape side edge portions of a pair of the airtight and waterproof tapes provided with an airtight and waterproof layer on at least one tape surface, wherein each fastener element is configured by holding together the tape side edge portion and a coupling element inside a clamp element with a U-shaped cross-section, and wherein the backing tape piece is fixed on at least one end portion side of the element row to stride across the pair of the airtight and waterproof tapes, comprising:

injection molding a stopper molding which comprises a molding body portion which embeds an end portion of the element row, and a thin fin portion which extends outward from a periphery portion of at least one portion of the molding body portion on at least one end portion side of the element row;

providing a first mold and a second mold;

providing a first accommodating hole portion and a second accommodating hole portion shallower than the first accommodating hole portion on an upper surface of the first mold adjacent to one another;

wherein a depth of the first accommodating hole portion is larger than a thickness of the at least one portion of the molding body portion excluding a thickness of the thin fin portion;

accommodating the molding body portion of the stopper molding in the first accommodating hole portion;

accommodating the element row in the second accommodating hole portion;

making the first mold and the second mold close relatively and pressurizing a space between the molds; and adhesion integrating the stopper to the airtight and waterproof tape and the backing tape piece by adhering the fin portion of the stopper molding by a high-frequency wave while pressing to the airtight and waterproof tape and the backing tape piece, and forming a high-frequency wave adhesion portion which is thinner than the fin portion.

One method for forming the stopper of the present invention comprises continuously providing the fin portion on the periphery portion excluding one portion area of the side surface portion of the element row side of the molding body portion.

A method for forming the stopper of the present invention may comprise making a surface of the high-frequency wave adhesion portion flat with respect to a tape surface of the airtight and waterproof tape. Further, it may comprise making the dimension in a tape front and back direction of the high-frequency wave adhesion portion with respect to the tape surface of the airtight and waterproof tape 0.1 mm or less.

Also, a most significant feature of an airtight and waterproof slide fastener provided by the present invention comprises a pair of first and second fastener stringers wherein a plurality of fastener elements are attached to facing tape side edge portions of a pair of the airtight and waterproof tape provided with an airtight and waterproof layer on at least one tape surface, wherein each fastener element is configured by holding together the tape side edge portion and a coupling element inside a clamp element with a U-shaped cross-section, and wherein the backing tape piece is adhered on at least one end portion side of the element row to stride across the pair of the airtight and waterproof tapes; a slider disposed slidably along the element row; and a thermoplastic elastomer stopper fixed on at least one end portion side of the element row to stride across the airtight and waterproof tape and the backing tape piece, and the stopper comprises a body portion which embeds an end portion of the element row, and a high-frequency wave adhesion portion which extends outward from a periphery portion of at least one portion of the body portion, and is adhered by a high-frequency wave.

In the airtight and waterproof slide fastener of the present invention, it is preferable that a surface of the high-frequency wave adhesion portion is disposed flat with respect to a tape surface of the airtight and waterproof tape, and also, it is preferable that the thickness in a tape front and back direction of the high-frequency wave adhesion portion with respect to the tape surface of the airtight and waterproof tape is 0.1 mm or less.

Further, in the airtight and waterproof slide fastener of the present invention, it is preferable that end portions of the element row are embedded in the stopper in a state separated from each other, a projecting portion having a triangular cross-section is disposed on the tape surface of the airtight and waterproof tape side of the backing tape piece along a length direction of the first and second fastener stringers so as to be sandwiched by the left and right airtight and waterproof tapes, and the projecting portion and the backing tape piece are adhered by the high-frequency wave.

Effect of the Invention

In the method for forming a stopper of the present invention, when forming the stopper to the first and second fastener stringers to which a backing tape piece is fixed, firstly, a thermoplastic elastomer stopper molding which is provided with a molding body portion and a thin fin portion is injection molded. Next, by adhering the injection molded fin portion of the stopper molding by a high-frequency wave while pressing the fin portion to the airtight and waterproof tape and the backing tape piece, and forming a thin-film high-frequency wave adhesion portion which is thinner than the fin portion, the stopper is adhesion integrated to the airtight and waterproof tape and the backing tape piece.

In this way, in the method for forming the stopper of the present invention, the stopper is adhesion integrated to the airtight and waterproof tape by high-frequency wave adhering the fin portion of the stopper molding while squashing the fin portion by pressing force. In such high-frequency wave adhesion, the stopper is adhered to the airtight and waterproof tape and the backing tape piece strongly and in a short time by vibrating molecules by a high-frequency wave (electromagnetic wave) energy using a heating due to the molecular movement.

For this reason, in the present invention, the fixing strength (adhesion strength) of the stopper can be largely increased without using the adhesive agent, compared to a conventional case where the stopper is fixed using the heat at the time of the injection molding for example like in Patent Document 1 or Patent Document 2. Also, the present invention can largely shorten the time required to form the stopper and increase productivity, compared to a case where the fixing strength of the stopper is enhanced for example by applying the adhesive agent.

Further, in the present invention, by performing the high-frequency adhesion, the forefront portion of the fin portion which was conventionally difficult to transfer the heat of the injection molding can also be adhered with certainty. In addition, since the fin portion of the stopper molding is adhered while pressed to the airtight and waterproof tape and the backing tape piece, the thickness (dimension in the tape front and back direction) of the high-frequency wave adhesion portion after the adhesion can be made thinner than the fin portion, and the high-frequency wave adhesion portion can be formed in a film form.

By forming the high-frequency wave adhesion portion of the stopper thin in this way, a difference in hardness (flexibility) between an high-frequency wave adhesion portion area and a high-frequency wave adhesion portion periphery portion area (that is, an area of the airtight and waterproof tape and the backing tape piece where the high-frequency wave adhesion portion is not disposed) can be made small. By this, when the airtight and waterproof slide fastener is bent or folded at the periphery portion of the stopper, the high-frequency wave adhesion portion of the stopper is easily bent in accordance with the airtight and waterproof tape (following the airtight and waterproof tape). Therefore, a force of restitution which occurs on the stopper when the high-frequency wave adhesion portion is bent can be suppressed to be smaller (eased).

Therefore, in the method for forming a stopper of the present invention, since the fixing strength of the stopper can be largely enhanced up to the forefront portion of the high-frequency wave adhesion portion, and the thickness of the high-frequency wave adhesion portion can be made thin to configure the high-frequency wave adhesion portion to be easily bent, the stopper which can prevent the occurrence of detachment for a long period of time can stably be formed. Note that, the stopper of the present invention comprises, for example, a first stopper (also called a lower stopper) which is disposed on a rear end portion of a slide fastener, and a second stopper (also called an upper stopper) provided on a front end portion of the slide fastener.

In such method for forming a stopper of the present invention, the fixing strength of the stopper can be enhanced with certainty by continuously providing the fin portion of the stopper molding on the periphery portion excluding one portion area of the side surface portion of the element row side of the molding body portion. Also, when high-frequency wave adhering the fin portion while pressing with a mold, interference of the element row of the first and second fastener stringers and the mold with respect to each other can be avoided, and the high-frequency wave adhesion can be done stably.

Also, in the present invention, when forming the high-frequency adhesion portion by high-frequency wave adhering the fin portion, by making the surface of the high-frequency wave adhesion portion flat with respect to the tape surface of the airtight and waterproof tape, the high-frequency wave adhesion portion of the stopper can be configured to bend more easily in accordance with the airtight and waterproof tape. For this reason, the force of restitution which occurs on the stopper when the high-frequency wave adhesion portion is bent can be suppressed to be smaller, and the detaching of the stopper can be efficiently prevented. By forming the surface of the high-frequency wave adhesion portion flat with respect to the tape surface of the airtight and waterproof tape, quality of appearance or feel of the airtight and waterproof slide fastener which comprises the stopper can be improved.

Further, in the present invention, a dimension in the tape front and back direction of the high-frequency wave adhesion portion of the stopper is made to be 0.1 mm or less. By forming the high-frequency wave adhesion portion in such thickness, the surface of the high-frequency wave adhesion portion can be flat with respect to the tape surface of the airtight and waterproof tape with certainty. For this reason, the high-frequency wave adhesion portion can be configured to more easily bend in accordance with the airtight and waterproof tape, as well as improving the quality of appearance and feel of the airtight and waterproof slide fastener.

Next, the airtight and waterproof slide fastener provided by the present invention comprises the thermoplastic elastomer stopper which is fixed to at least one end portion side of the element row, and the stopper comprises the body portion which embeds the end portion of the element row, and the thin high-frequency wave adhesion portion which spreads extending outward from a periphery portion of at least one portion of the body portion.

In such stop of the airtight and waterproof slide fastener of the present invention, since the high-frequency wave adhesion portion which is adhered to the airtight and waterproof tape and the backing tape piece by the high-frequency wave is disposed, the fixation between the stopper with the airtight and waterproof tape and the backing tape piece becomes strong without the adhesive layer due to the adhesive agent, and further, high fixing strength can be stably secured even on the forefront portion of the high-frequency wave adhesion portion.

Therefore, when the airtight and waterproof slide fastener provided by the present invention is for example bent at a periphery portion of the stopper, the stopper (particularly the high-frequency wave adhesion portion of the stopper) can be efficiently prevented from detaching, and the airtightness and waterproof property which the airtight and waterproof slide fastener comprises can be stably maintained for a long period of time.

Also, since the high-frequency wave adhesion portion of the stopper is formed extremely thin, a difference in hardness (flexibility) between the high-frequency wave adhesion portion area and the high-frequency wave adhesion portion periphery portion area can be made small. By this, when the airtight and waterproof slide fastener is bent or folded at the periphery portion of the stopper, the high-frequency wave adhesion portion of the stopper can be easily bent following the airtight and waterproof tape, and therefore, a force of restitution which occurs on the stopper when the high-frequency wave adhesion portion is bent can be suppressed to be smaller.

In this way, in the airtight and waterproof slide fastener of the present invention, since the fixing strength of the stopper is largely increased, and the high-frequency wave adhesion portion is configured to be easily bent by making the thickness of the high-frequency wave adhesion portion thin, the stopper can be prevented from detaching from the airtight and waterproof tape or the backing tape piece for a long period of time.

In such airtight and waterproof slide fastener of the present invention, a surface of the high-frequency wave adhesion portion is disposed flat with respect to a tape surface of the airtight and waterproof tape. By this, since a difference in hardness between the high-frequency wave adhesion portion area and the high-frequency wave adhesion portion periphery portion area can be made extremely small, the high-frequency wave adhesion portion of the stopper can be easily bent following the airtight and waterproof tape when the airtight and waterproof slide fastener is bent at the periphery portion of the stopper. Therefore, the stopper can be efficiently prevented from detaching. Also, by the surface of the high-frequency wave adhesion portion being flat with respect to the tape surface of the airtight and waterproof tape, the quality of appearance and feel of the airtight and waterproof slide fastener can be improved.

Also, in the present invention, by the thickness in the tape front and back direction of the high-frequency wave adhesion portion with respect to the tape surface of the airtight and waterproof tape being 0.1 mm or less, the surface of the high-frequency wave adhesion portion becomes flat with certainty with respect to the tape surface of the airtight and waterproof tape, and therefore, the high-frequency wave adhesion portion of the stopper can be configured to bend further easily in accordance with the airtight and waterproof tape, and the quality of appearance or feel of the airtight and waterproof slide fastener can be improved.

Further, in the airtight and waterproof slide fastener of the present invention, the end portions of the element row are embedded in the stopper in a state separated from each other, and on the tape surface of the side of the backing tape piece which is fixed to the airtight and waterproof tape, a projecting portion having a triangular cross-section is disposed so as to be sandwiched by the left and right airtight and waterproof tapes. Also, the projecting portion is disposed along the length direction of the first and second fastener stringers, and the projecting portion and the backing tape piece are strongly adhered using the high-frequency wave.

Because such projecting portion is disposed, for example when the left and right element rows are coupled by sliding the slider to a position contacting the stopper, since the slider can be securely close-contacted with the projecting portion and the airtight and waterproof tape, the airtightness and the waterproof property when the waterproof fastener is closed can further be increased.

MODE(S) FOR CARRYING OUT THE INVENTION

Hereinafter, a preferable embodiment of the present invention will be explained in detail with examples and with reference to drawings.

Embodiment 1

Figure 1:
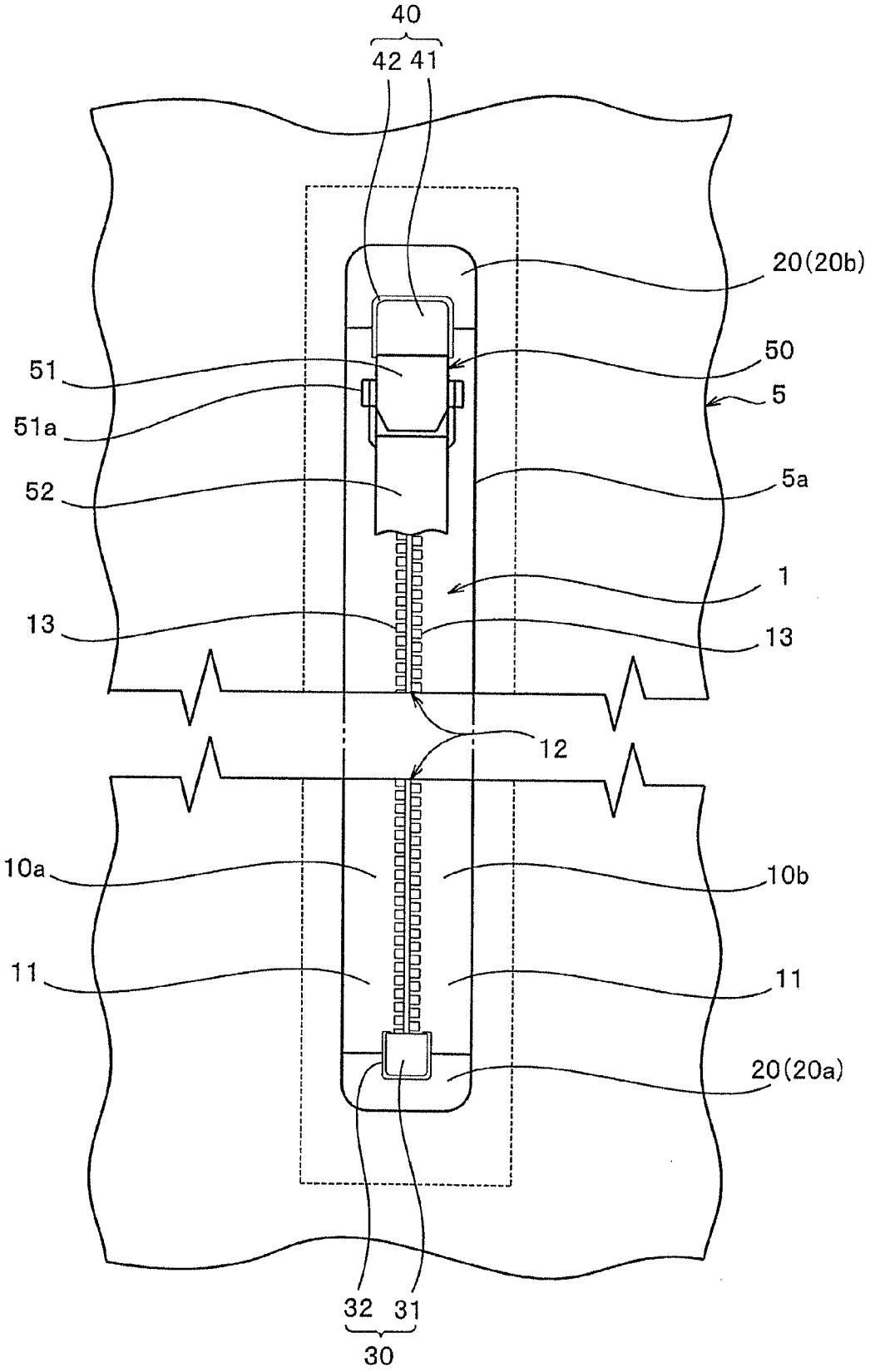
FIG. 1 is a plain view illustrating a state in which an airtight and waterproof slide fastener of an embodiment of the present invention is attached to a product to which a fastener is attached.
Figure 2:
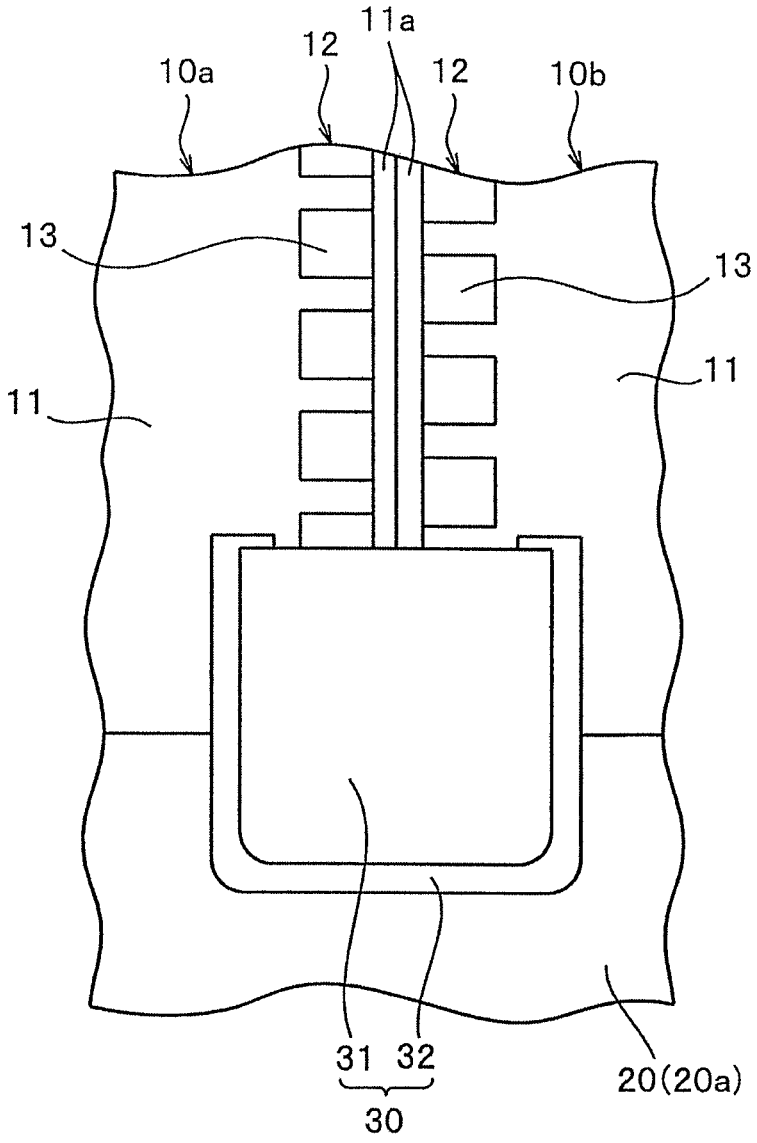
FIG. 2 is an enlarged plain view illustrating a first stopper (lower stopper) of the airtight and waterproof slide fastener.
Figure 3:
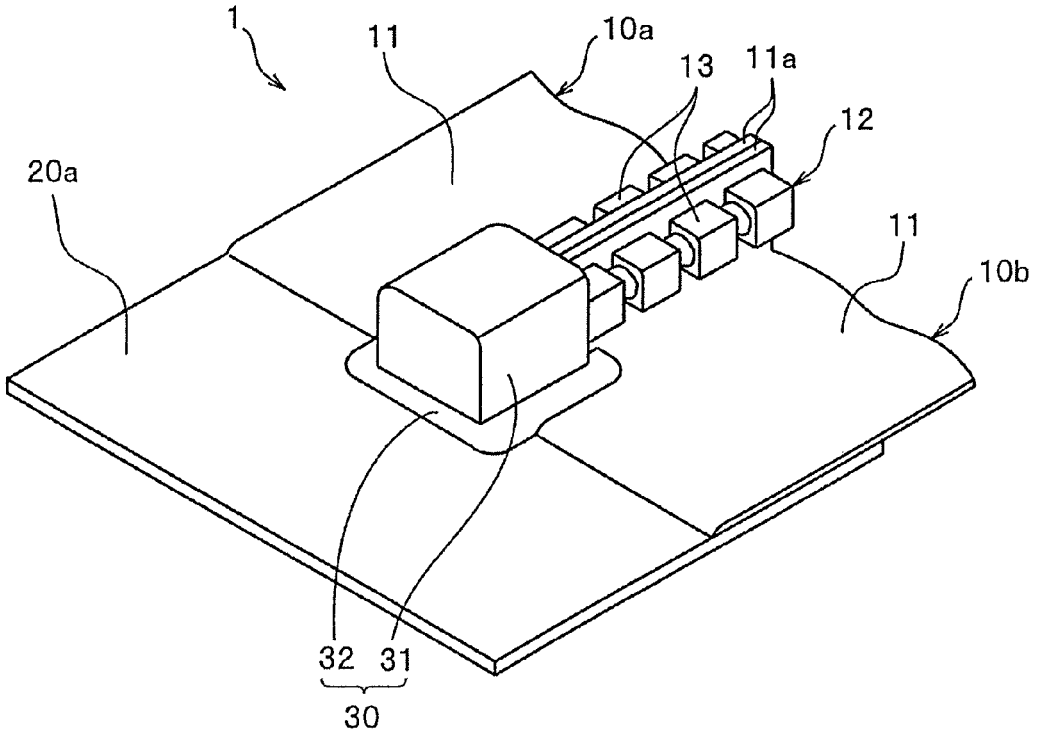
FIG. 3 is a perspective view of the first stopper.
Figure 9:
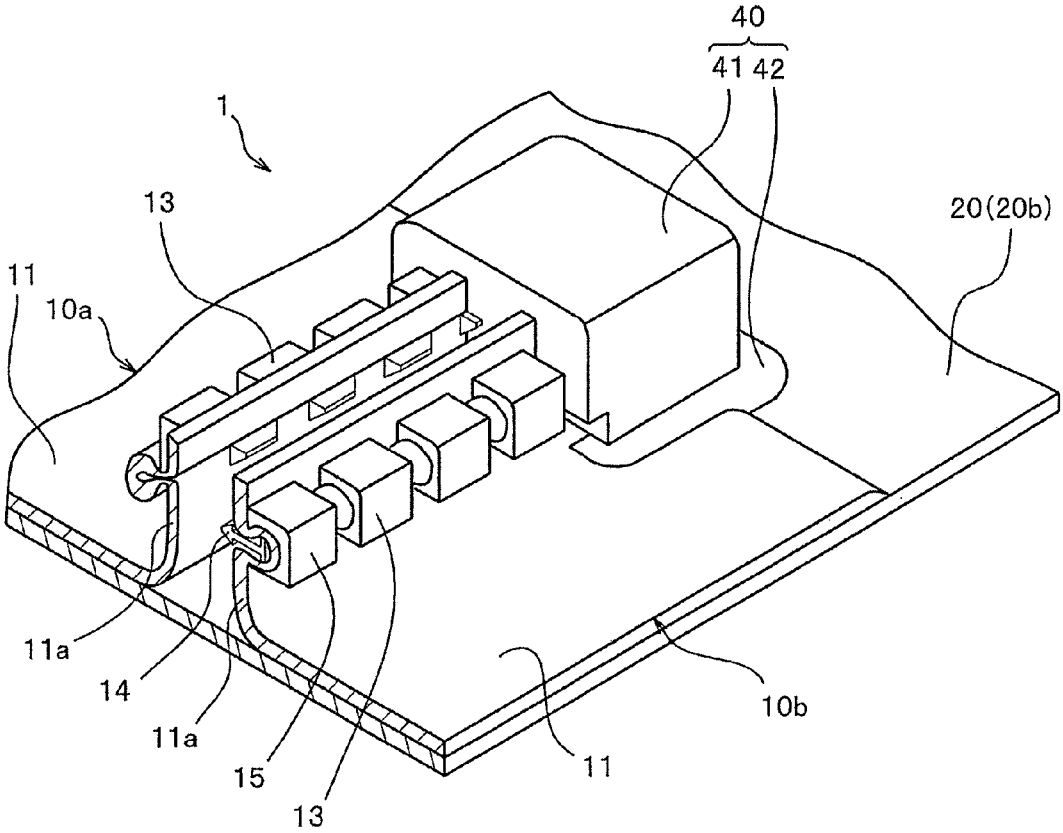
FIG. 9 is an enlarged perspective view illustrating a second stopper (upper stopper) of the airtight and waterproof slide fastener.
Figure 10:
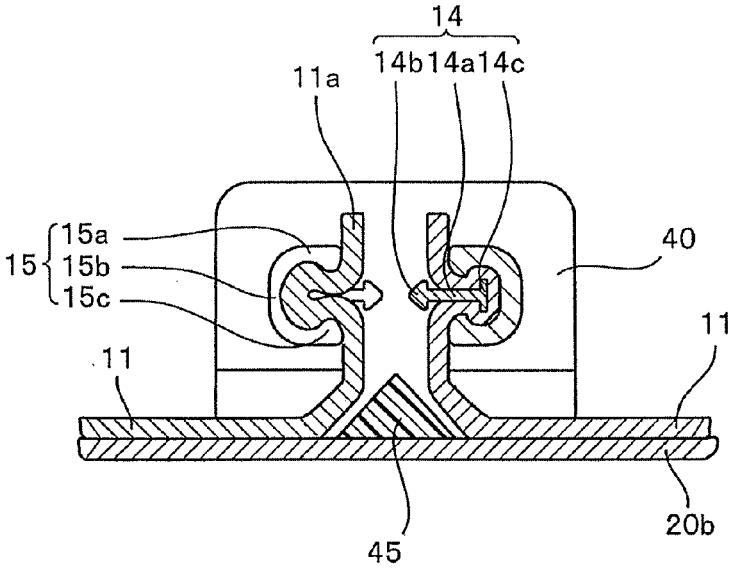
FIG. 10 is a cross-section view illustrating a protruding portion disposed near the second stopper.

FIG. 1 is a plain view illustrating a state in which an airtight and waterproof slide fastener of Embodiment 1 (hereinafter, referred simply as "waterproof fastener") is attached to a product to which a fastener is attached. Also, FIG. 2 is a plain view of a first stopper disposed on the waterproof fastener, and FIG. 3 is a perspective view of the first stopper. Further, FIG. 9 is a perspective view of a second stopper disposed on the waterproof fastener, and FIG. 10 is a cross-section view illustrating a protruding portion disposed near the second stopper.

Note that in the below description, a tape length direction of the airtight and waterproof tape is defined as a front and rear direction, and particularly in Embodiment 1, a direction in which a slider is slid to couple left and right fastener elements is a front direction, and a direction in which the slider is slid to separate the left and right fastener elements is a rear direction.

Also, a tape width direction of the airtight and waterproof fastener tape is defined as a left and right direction, and particularly, a left side in a plain view of the waterproof fastener like in FIG. 1 is a left direction, and a right side is a right direction. Further, a tape front and back direction of the airtight and waterproof tape is defined as a upper and lower direction, a side in which a tab of the slider is disposed with respect to a tape surface of the airtight and waterproof tape is an upper direction, and its opposite side is a lower direction.

The waterproof fastener 1 of present Embodiment 1 is attached to an opening portion 5*a* of a product to which a fastener is attached 5 as shown in FIG. 1, and it is equipped with airtightness and waterproof property so that gas or liquid does not leak through the waterproof fastener 1 from an outside to an inside (or inside to outside) of the product to which the fastener is attached (for example, a flexible container) 5 when the waterproof fastener 1 is closed. In this case, the waterproof fastener 1 is attached to the product to which the fastener is attached 5 by an upper surface (front surface) of left and right airtight and waterproof tapes 11 to be described later being adhered to a back surface side of a periphery of the opening portion 5*a* of the product to which the fastener is attached 5 by a high-frequency wave.

Such waterproof fastener 1 of present Embodiment 1 comprises: left and right first and second fastener stringers 10*a*, 10*b* in which an element row 12 is disposed at facing tape side edge portions 11*a* of the pair of left and right airtight and waterproof tapes 11; a backing tape piece 20 fixed on a front end portion and a rear end portion of the first and second fastener stringers 10*a*, 10*b*; a first stopper 30 (may also be called a lower stopper) disposed at a rear end side of the element row 12; a second stopper 40 (may also be called an upper stopper) disposed at a front end side of the element row 12; and a slider 50 disposed slidably along the element row 12.

The first and second fastener stringers 10*a*, 10*b* of present Embodiment 1 are provided with the airtight and waterproof tape 11, and a plurality of fastener elements 13 attached on the tape side edge portion 11*a* of the airtight and waterproof tape 11, respectively.

Each left and right airtight and waterproof tape 11 are configured by lamination of an airtight and waterproof layer comprised of a polyurethane or vinyl chloride thermoplastic elastomer on a tape upper surface and a tape lower surface of a woven or knitted fastener tape. By the airtight and waterproof layer being comprised of the thermoplastic elastomer as above, since it is possible to bend the airtight and waterproof tape in the tape front and back direction or the tape width direction, it is easy to handle the airtight and waterproof slide fastener.

In this case, the airtight and waterproof tape 11 is formed by supplying the fastener tape and a film between a heated pair of rollers in a state where the thermoplastic elastomer film is overlapped on the tape upper and lower surface of the fastener tape, and attaching the upper and lower films to the fastener tape.

Note that, in the present invention, it is possible to configure the airtight and waterproof tape by providing the airtight and waterproof layer on only one tape surface (for example the tape upper surface) of the fastener tape. Also, by extrusion molding the thermoplastic elastomer in a sheet shape, it is possible to configure the airtight and waterproof tape which is comprised only of the elastomer.

As shown in FIG. 9, the fastener element 13 is attached to the tape side edge portion 11*a* bent in a substantially Q shape of the airtight and waterproof tape 11. Also, the element row 12 is configured by attaching the plurality of fastener elements 13 on the tape side edge portion 11*a* along a longitudinal direction at regular intervals. This fastener element 13 is configured in a substantially same manner as the fastener elements of the waterproof fasteners according to Patent Document 1 and Patent Document 2.

Figure 7:
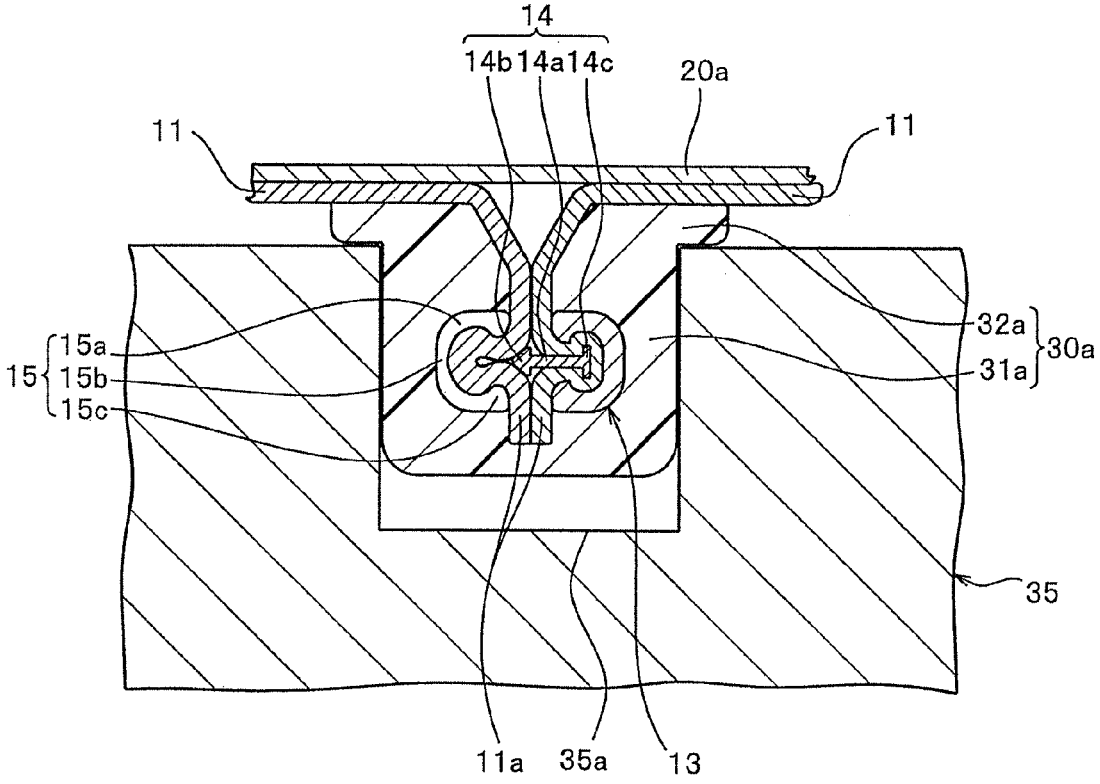
FIG. 7 is a cross-section view along a VII-VII line shown in FIG. 6.

To explain specifically, as shown in FIG. 7 or FIG. 10, each fastener element 13 is comprised of a metal coupling element 14 and a metal clamp element 15. In this case, the coupling element 14 comprises a rectangular column portion 14*a*, an arrowhead-shaped coupling head portion 14*b* disposed on a forefront of the rectangular column portion 14*a*, and a flange portion 14*c* disposed at a base end of the rectangular column portion 14*a*.

On the other hand, the clamp portion 15 is comprised of a bent plate piece which is bent in a U-shape, and comprises a pair of upper and lower plate-shaped sandwiching piece 15*a* which is inclined so that a facing interval at one end is wider than the facing interval at the other end, a connection portion 15*b* which connects the other end side of the plate-shaped sandwiching piece 15*a*, and a lip portion (protruding portion) 15*c* which protrudes from one end portion to a facing direction of the plate-shaped sandwiching piece 15*a*. Further, in a bent inner surface of the clamp element 15 including the lip portion 15*c*, a plurality of recessed grooves (not illustrated) that extend linearly in the bending direction are formed.

A fastener element 13 which comprises the above coupling element 14 and the clamp element 15 is attached to the tape side edge portion 11*a* of the airtight and waterproof tape 11 by covering the clamp element 15 over the tape portion which embraces the coupling element 14, in a state where the tape side edge portion 11*a* of the airtight and waterproof tape 11 is bent in an Ω shape so as to expose the coupling head portion 14*b* of the coupling element 14 to the outside at the same time as embracing the flange portion 14*c* and the rectangular-shaped column portion 14*a* of the coupling element 14, and further by forcing bending and deformation of the clamp element 15 by swaging towards the tape portion. Note that, the fastener element of the present invention includes a case where the coupling element and the clamp element are integrally formed.

The backing tape piece 20 is fixed on a front end portion and a rear end portion of the first and second fastener stringers 10*a*, 10*b* respectively, so as to extend in a front direction and a rear direction from a front end edge and a rear end edge of the first and second fastener stringers 10*a*, 10*b*. Each backing tape piece 20 is, alike the airtight and waterproof tape 11, configured by disposing an airtight and waterproof layer comprised of a polyurethane or vinyl chloride thermoplastic elastomer on an upper surface and a lower surface of a woven or knitted band-shaped tape.

In this case, a front end portion of a first backing tape piece 20*a* disposed at a rear end portion side of the waterproof fastener 1 is fixed to a tape lower surface (tape back surface) of each airtight and waterproof tape 11 to stride across the left and right airtight and waterproof tape 11. And as shown in FIG. 3, a front end edge of the first backing tape piece 20*a* is positioned anteriorly than the first stopper 30.

Also, the rear end portion of the second backing tape piece 20*b* disposed at a front end portion side of the waterproof fastener 1 is fixed to the tape lower surface of each airtight and waterproof tape 11 so as to stride across the left and right airtight and waterproof tapes 11. This rear end edge of the second backing tape piece 20*b* is positioned posteriorly than the second stopper 40, and a projecting portion 45 to be described later with a triangular-shaped cross-section is disposed so as to be sandwiched by the left and right airtight and waterproof tapes 11 on the tape upper surface which is on a posterior side than the second stopper 40 of the second backing tape piece 20*b*.

In this case, a means of fixing the airtight and waterproof tape 11 with the first and second backing tape piece 20*a*, 20*b* is not particularly limited, however, in present Embodiment 1, the first and second backing tape piece 20*a*, 20*b* and the airtight and waterproof tape 11 are adhered using a high-frequency wave.

As shown in FIG. 2 and FIG. 3, the first stopper 30 of present Embodiment 1 is fixed to stride across the rear end portion of the airtight and waterproof tape 11 of the first and second fastener stringers 10*a*, 10*b*, and the first backing tape piece 20*a* disposed at the rear end side.

Also, the first stopper 30 is configured by using the thermoplastic elastomer. Particularly, it is preferable that the first stopper 30 is configured by using the polyurethane thermoplastic elastomer alike an airtight and waterproof layer, in a case where for example the airtight and waterproof layer of the airtight and waterproof tape 11 and the backing tape piece 20 is comprised by the polyurethane thermoplastic elastomer.

Further, the first stopper 30 comprises a substantially cuboid shaped body portion 31 which embeds the coupled state rear end portion of the element row 12, and a high-frequency wave adhesion portion 32 which extends to the front and rear direction and the left and right direction so as to surround the body portion 31 from a lower end of the body portion 31.

When the first stopper 30 is viewed from the upper surface side, the high-frequency wave adhesion portion 32 is comprised of a portion which extends to the outside from the cuboid-shape body portion 31. The high-frequency wave adhesion portion 32 is, as will be described later, is formed thin in a thin film shape by applying the high-frequency wave while pressing a fin portion 32*a* which an injection molding (first stopper molding) of the first stopper 30 comprises, squashing the fin portion 32*a* and adhering it to the airtight and waterproof tape 11 and the backing tape piece 20 (refer to FIG. 4 and FIG. 6 to FIG. 8).

That is to say, the high-frequency wave adhesion portion 32 is adhered firmly to the airtight and waterproof tape 11 and the backing tape piece 20 by using heat generation derived from vibration of molecules that comprise the first stopper 30 when the high-frequency wave is applied. For this reason, the fixing strength of the first stopper 30 of present Embodiment 1 towards the airtight and waterproof tape 11 and the backing tape piece 20 is largely increased compared for example to conventional stoppers fixed by only using heat at the time of injection molding like those of Patent Document 1 or Patent Document 2.

Also, the high-frequency wave adhesion portion 32 of the first stopper 30 extends towards the outside from the left and right side surface portions and the rear side surface portion of the body portion 31, and both the left and right end portions of the front side surface portion of the body portion 31, so as to avoid the element row 12 that extends from the body portion 31. The reason the high-frequency wave adhesion portion 32 comprises such form is because when forming the high-frequency wave adhesion portion 32 by adhering the fin portion 32*a* of the first stopper molding 30*a* shown in FIG. 4, it is necessary to avoid interference of a mold with the element row 12, at the same time as pressing the fin portion 32*a* by the mold.

Further, the high-frequency wave portion 32 is configured so that a dimension in a tape front and back direction (that is, a thickness of the high-frequency wave adhesion portion 32) from the tape upper surface of the airtight and waterproof tape 11 and the backing tape piece 20 to the upper surface of the high-frequency wave adhesion portion 32 is 0.1 mm or less, and preferably 0.05 mm or less.

For example, the first stopper (lower stopper) of the conventional waterproof fastener according to Patent Document 1 or Patent Document 2 is formed only by injection molding. In this case, from the problem of flow resistance or cooling of the fused resin at the time of injection molding, it is extremely difficult to provide a molding portion with a thickness of 0.5 mm or less, particularly 0.1 mm or less, in the injection molding. For this reason, the fin portion of the conventional stopper was thickly formed to comprise a thickness of 1.2 mm or more as explained in the above column of the Background Art.

On the other hand, the high-frequency wave adhesion portion 32 of the first stopper 30 of Embodiment 1 has, as explained above, a thickness of 0.1 mm or less which was not achieved by the conventional stopper, and the upper surface of the high-frequency wave adhesion portion 32 is provided flat with respect to the tape upper surface of the airtight and waterproof tape 11 and the backing tape piece 20.

By this, a difference in strength (rigidity) with respect to bending can be made fairly small between the high-frequency wave adhesion portion 32 area and the peripheral tape area of the high-frequency wave adhesion portion 32. And for example when the waterproof fastener 1 of present Embodiment 1 is bent at a periphery portion of the first stopper 30, the high-frequency wave adhesion portion 32 of the first stopper 30 can be easily bent so as to follow the airtight and waterproof tape 11 and the backing tape piece 20.

Here, the thickness of the high-frequency wave adhesion portion 32 is measured for example in the below method.

First, a total thickness (hereinafter, this thickness is referred to as a total thickness A) from the upper surface (front surface) of the high-frequency wave adhesion portion 32 to the lower surface (back surface) of the airtight and waterproof tape 11 or the backing tape piece 20 is measured at a substantially medium position between the base end portion of the body portion 31 side of the high-frequency wave adhesion portion 32 and the forefront portion of the outer side. In this case, the total thickness A can for example be a thickness at a position where it is turned inward at a predetermined length (for example 1 mm) from the outer side forefront portion of the high-frequency wave adhesion portion 32 towards the body portion 31, not only the thickness at a substantially medium position of the high-frequency wave adhesion portion 32.

Next, a total thickness (hereinafter, this thickness is referred to as a total thickness B) from the upper surface to the lower surface of the airtight and waterproof tape 11 or the backing tape piece 20 at an outer side area of the high-frequency wave adhesion portion 32 is measured. After, the thickness of the high-frequency wave adhesion portion 32 can be obtained by calculating the difference between the total thickness A and the total thickness B.

Figure 11:
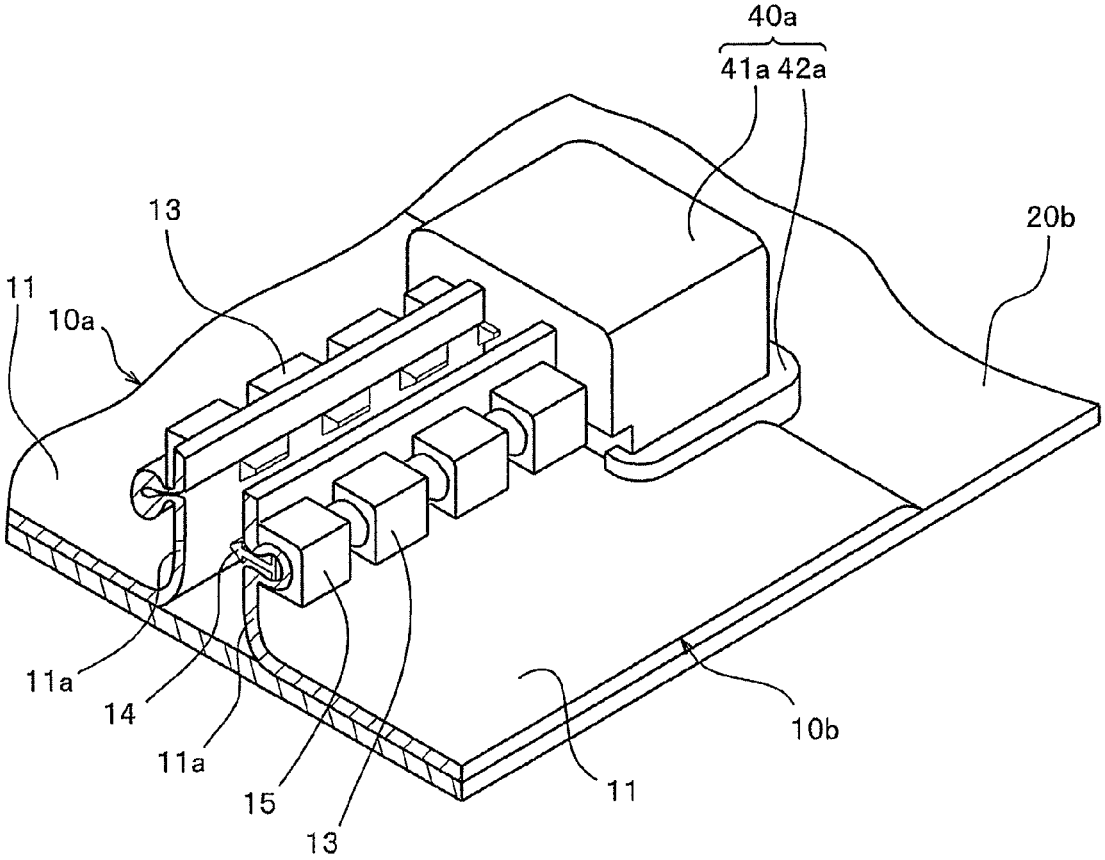
FIG. 11 is a perspective view illustrating the injection molding of the second stopper.

The second stopper 40 of present Embodiment 1 is, as shown in FIG. 9 and FIG. 11, fixed to stride across the front end portion of the airtight and waterproof tape 11 of the first and second fastener stringers 10*a*, 10*b*, and the second backing tape piece 20*b* disposed at the front end side. Also, the second stopper 40 is, alike the first stopper 30, configured by using the thermoplastic elastomer, and preferably configured particularly by using the polyurethane thermoplastic elastomer.

This second stopper 40 comprises the substantially cuboid-shape body portion 41 in which the front end portion of the element row 12 in a separated state is embedded, and the high-frequency wave adhesion portion 42 which extends to the front and rear direction and the left and right direction so as to surround the body portion 41 from the lower end of the body portion 41. The high-frequency wave adhesion portion 42 is, as will be described later, formed by adhering the fin portion 42*a* which the injection molding (second stopper molding) 40*a* of the second stopper 40 comprises to the airtight and waterproof tape 11 and the backing tape piece 20 by applying the high-frequency wave while pressing. And when the second stopper 40 is viewed from the upper surface side, it is configured from a portion which extends to the outside from the cuboid-shape body portion 41.

The fixing strength of the second stopper 40 which comprises the above high-frequency wave adhesion portion 42 is, alike the case of the first stopper 30, largely increased compared to the conventional stopper which is fixed only by using heat at the time of injection molding. Also, the high-frequency wave adhesion portion 42 of the second stopper 40 extends towards the outside from the left and right side surface portion and the front side surface portion of the body portion 41, and both the left and right end portions of the rear side surface portion of the body portion 41, to avoid interference of the mold and the element row 12 when the fin portion 42*a* which the injection molding of the second stopper 40 comprises is adhered through the high-frequency wave, as will be described later.

Further, the thickness of the high-frequency wave adhesion portion 42 of the second stopper 40 is, alike the high-frequency wave adhesion portion 32 of the first stopper 30, set to be 0.1 mm or less, preferably to be 0.05 mm or less. Also, the upper surface of the high-frequency wave adhesion portion 42 is configured flat with respect to the tape upper surface of the airtight and waterproof tape 11 and the tape backing piece 20. By this, when the airtight and waterproof slide fastener is bent at a periphery portion of the second stopper 40, the high-frequency wave adhesion portion 42 of the second stopper 40 can be easily bent so as to follow the airtight and waterproof tape 11 and the backing tape piece 20.

In present embodiment 1, on the upper surface of the second backing tape piece 20*b* disposed at the front end portion of the waterproof fastener 1, a projecting portion 45 having a triangular cross-section as shown in FIG. 10 is disposed so as to be sandwiched by the left and right airtight and waterproof tapes 11. The projecting portion 45 is configured to be engaged and inserted between inverted V-shaped protruding piece portions which is vertically arranged from the bottom surface portion (lower surface portion) of the slider 50 to be described later when the slider 50 is contacted to the second stopper 40.

For example when the slider 50 is slid to a position to contact the second stopper 40 to close the waterproof fastener 1, by the above mentioned projecting portion 45 being disposed, the inverted V-shaped protruding piece portions disposed on the slider 50 can be close-contacted with the triangular projecting portion 45 and the left and right airtight and waterproof tapes 11, respectively. Therefore, the airtightness and the water proof property of the waterproof fastener 1 at the time of closure can be further increased.

To explain in detail, for example when the slider 50 is slid to a position to contact the second stopper 40 to couple the left and right element rows 12, although the left and right element rows 12 are strongly in close-contact by coupling, since the slider 50 merely is in contact with the second stopper 40, it is difficult to obtain a strong close-contact state between the slider 50 and the second stopper 40. For this reason, in a case where the waterproof fastener not provided with the projecting portion 45 as in present Embodiment 1 is used under severe circumstances, there is fear that gas or liquid enters through between the slider and the second stopper, and there is a possibility that high airtightness or waterproof property cannot be achieved.

Regarding the above problem of airtightness or waterproof property, in the waterproof fastener 1 of present Embodiment 1, by providing the aforementioned triangular projecting portion 45, when the slider 50 contacts the second stopper 40, the triangular projecting portion 45 engages and inserts between the inverted V-shaped protruding piece portions provided on the slider 50. And, the inverted V-shaped protruding piece portion disposed on the slider 50 can easily be in close-contact with the triangular projecting portion 45 and the left and right airtight and waterproof tapes 11 (particularly, the tape side edge portion 11*a* bent so as to stand at a substantially 90° angle with respect to the airtight and waterproof tape 11).

By this, even in a case where gas or liquid enters from between the slider 50 and the second stopper 40, gas or liquid that has entered can be blocked, and leakage of gas or liquid can be prevented at a close-contact portion between the bottom surface portion of the slider 50, and the triangular projecting portion 45 and the airtight and waterproof tape 11. Therefore, high airtightness or waterproof property of the waterproof faster 1 can be obtained stably.

In the present embodiment 1, the triangular projecting portion 45 is configured with the same material as that of the second stopper 40, and is disposed at a predetermined length along a front and rear direction (length direction) of the waterproof fastener 1. The triangular projecting portion 45 can be disposed to connect to the rear side surface which the slider 50 of the second stopper 40 contacts, or can be disposed by being separated at a predetermined length from the rear side surface of the second stopper 40.

Such triangular projecting portion 45 is adhered to the second backing tape piece 20*b* by injection molding a molding of the projecting portion 45 having a predetermined size on the second backing tape piece 20*b*, then afterwards applying the high-frequency wave to the lower end portion of the projecting portion molding while pressing the projecting portion molding towards the second backing tape piece 20*b*. Therefore, the triangular projecting portion 45 is fixed to the second backing tape piece 20*b* with high fixing strength.

The slider 50 used in the waterproof fastener 1 of the present Embodiment 1 is provided with a slider body 51, and a tab 52 rotatably maintained at the slider body 51. The slider body 51 is provided with a hexagonal-shaped upper surface portion, left and right flange portions having a L-shaped cross-section and vertically arranged from left and right side end portions of the upper surface portion, a guide post vertically arranged downward from a center portion of a left and right direction of the front end side of the upper surface portion, a bottom surface portion (lower surface portion) flaring towards the outside at a lower end of the guide post, two protruding piece portions protruding from the bottom surface portion to a diagonal downward direction in an inverted V-shape, and a tab maintaining portion 51*a* arranged to protrude to a left and right direction (tape width direction) from the outside surface of the left and right flange portions.

In this case, the inverted V-shaped protruding piece portion is arranged along the front and rear direction (tape length direction), and a triangular space in which the triangular projecting portion 45 can be coupled and inserted to be closely-contacted is provided between the two protruding piece portions.

Also, at the front end of the slider body 51, left and right shoulder orifices are formed sandwiching the guide post in between, along with a rear orifice formed on the rear end of the slider body 51. Inside the slider body 51, a substantially Y-shaped element guide path which communicates the left and right shoulder orifices and the rear orifice is formed, and the left and right element rows 12 can be coupled/separated by passing the left and right element rows 12 in the element guide path by sliding the slider 50.

In the present invention, the material of the slider 50 is not particularly limited, and the slider body 51 can for example be configured by using a synthetic resin such as polyamide, polyplopyrene, and polyathetare, or a metal such as aluminum alloy and zinc alloy.

Next, a method for manufacturing the waterproof fastener 1 of present Embodiment 1 will be explained.

Firstly, the airtight and waterproof tape 11 and the backing tape piece 20 are formed separately. For example, the fastener tape is weaved or knitted, then in a state where a polyurethane or vinyl chloride thermoplastic elastomer film is overlapped on upper and lower surfaces of the obtained fastener tape, the fastener tape is supplied between a pair of heating rollers to adhere the upper and lower films to the fastener tape. By this, the airtight and waterproof tape 11 and the backing tape piece 20 provided with the airtight and waterproof layer on the tape upper surface and the tape lower surface can be obtained respectively.

Next, the first and second fastener stringers 10*a*, 10*b* are configured by attaching the plurality of fastener elements 13 on the tape side edge portions 11*a* of the pair of left and right airtight and waterproof tapes 11. To attach the fastener elements 13 to the airtight and waterproof tape 11, firstly, the tape side edge portion 11*a* of the airtight and waterproof tape 11 is bent along the tape length direction so as to stand with respect to the tape main body.

Subsequently, the tape side edge portion 11*a* of the airtight and waterproof tape 11 is bent in an Ω-shape, and further, the coupling elements 14 of the fastener elements 13 are provided to the Ω-shape bent tape side edge portion 11*a* to hold and maintain the flange portion 14*c* and the rectangular column portion 14*a* of the coupling element 14 at the tape side edge portion 11*a*. At this time, the coupling element 14 is held and maintained in the tape side edge portion 11*a* in a state where the coupling head portion 14*b* of the coupling element 14 is exposed to the outside from the Ω shape bent tape side edge portion 11*a*.

After, the clamp element 15 is covered on the tape portion which holds the flange portion 14*c* and the rectangular column portion 14*a* of the coupling element 14. Further, the clamp element 15 is forced to be bent and deformed by swaging the clamp element 15 towards the tape portion. By this, the fastener element 13 is implanted to the tape side edge portion 11*a* of the airtight and waterproof tape 11 in a state where the coupling head portion 14*b* of the coupling element 14 is protruded outwards. By forming the element row 12 by sequentially attaching the plurality of fastener elements 13 to the tape side edge portion 11*a* of the airtight and waterproof tape 11 in this way, the first and second fastener stringers 10*a*, 10*b* are configured.

Next, the backing tape piece 20 is fixed to the rear end portion and the front end portion of the first and second fastener stringers 10*a*, 10*b* so as to stride across the left and right airtight and waterproof tapes 11. At this time, the high-frequency wave adhesion is used to fix the backing tape piece 20 and the airtight and waterproof tape 11.

In detail, after overlapping the lower surface (back surface) of the left and right airtight and waterproof tapes 11 and the upper surface (front surface) of the backing tape piece 20, the high-frequency wave is applied to a border portion of the backing tape piece 20 and the airtight and waterproof tape 11 while pressing both towards a direction to close-contact each other. By this, the backing tape piece 20 and the airtight and waterproof tape 11 are strongly adhered.

After adhering the backing tape piece 20 to the first and second fastener stringers 10*a*, 10*b*, the first stopper 30 is formed so as to embed the rear end portion of the element row 12.

Figure 4:
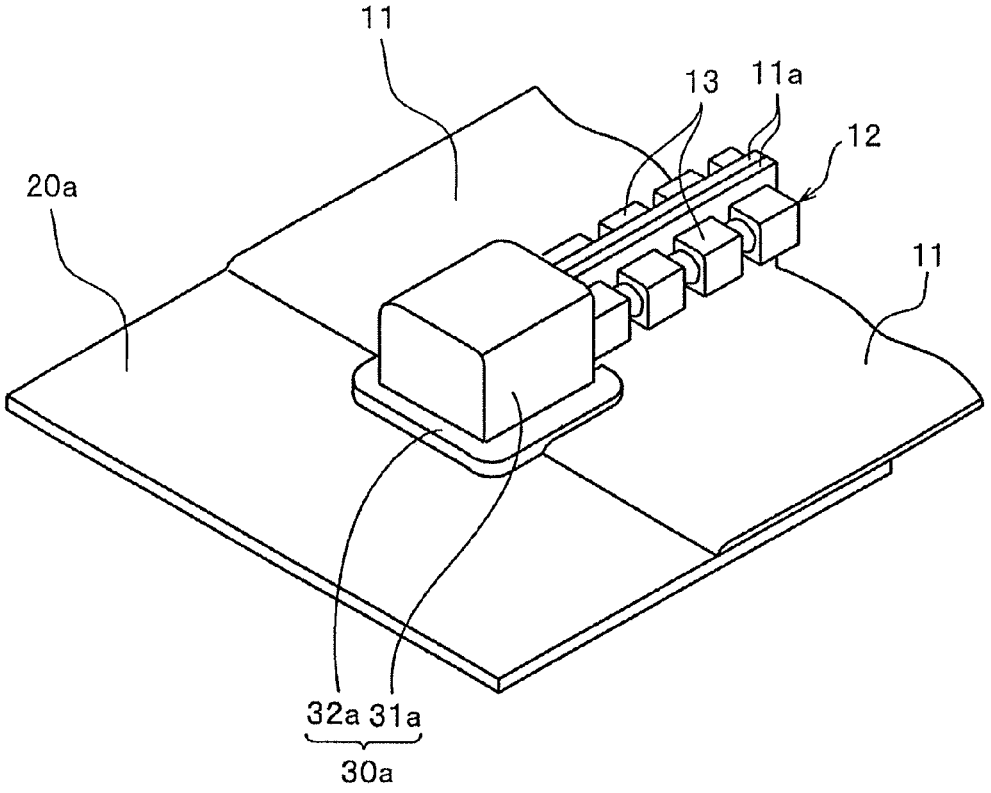
FIG. 4 is a perspective view illustrating an injection molding of the first stopper.

In the case of forming this first stopper 30, firstly, the first stopper molding 30*a* as shown in FIG. 4 is injection molded so as to stride across the rear end portion upper surface of the airtight and waterproof tape 11 and the upper surface of the first backing tape piece 20*a* using the thermoplastic elastomer. The first stopper molding 30*a* comprises a substantially cuboid-shape molding body portion 31*a* which embeds the rear end portion of the element row 12, and a fin portion 32*a* which extends outward from the lower end portion of the molding body portion 31*a*.

In this case, the rear end portion of the element row 12 is embedded inside the molding body portion 31*a* of the first stopper molding 30*a* in a state where the left and right element rows 12 are coupled. Also, the fin portion 32*a* of the first stopper molding 30*a*, with a thickness of 0.7 mm, is extended outwards from the left and right side surface portions and the rear side surface portion of the body portion 31, and both left and right end portions of the front side surface portion of the molding body portion 31*a* avoiding the element row 12, so as to surround the periphery portion of the molding body portion 31*a*. And this fin portion 32*a* is formed continuously.

Figure 5:
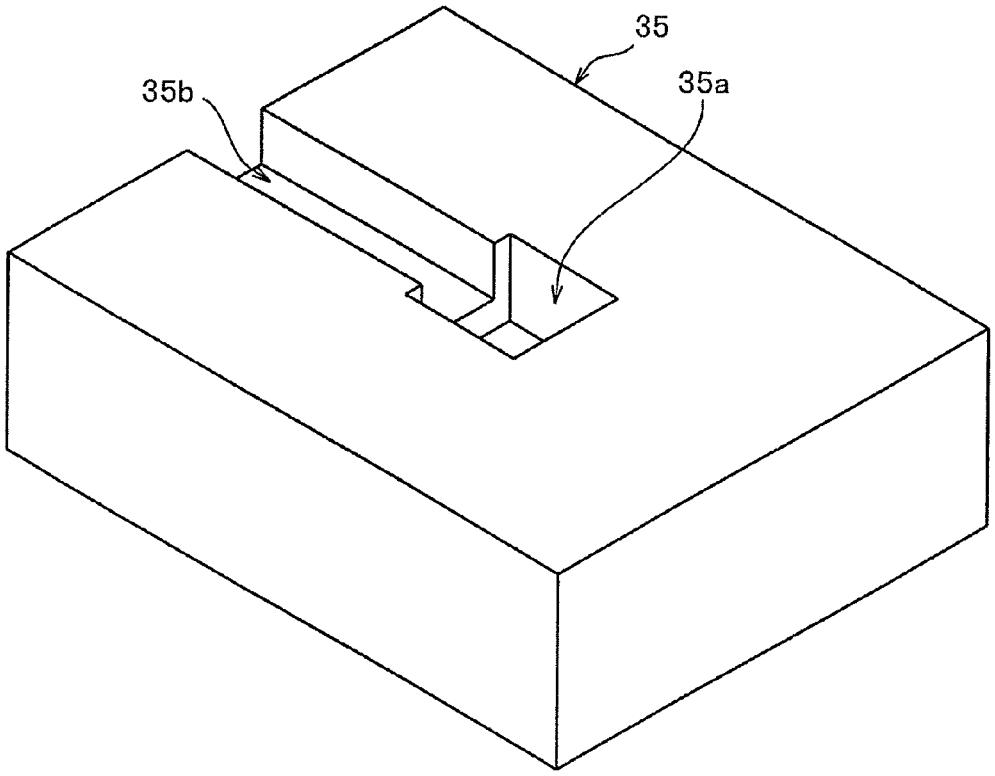
FIG. 5 is a perspective view illustrating a mold (bottom mold) used to apply a high-frequency wave adhesion to the injection molding of the first stopper.

After molding of the first stopper molding 30*a*, a first mold 35 as shown in FIG. 5, and a flat plate-shaped second mold 36 are prepared. In this case, a first accommodating hole portion 35*a* which accommodates the molding body portion 31*a* of the first stopper molding 30*a*, and a second accommodating hole portion 35*b* which accommodates the element row 12 in a coupled state are provided on the upper surface of the first mold 35.

Figure 6:
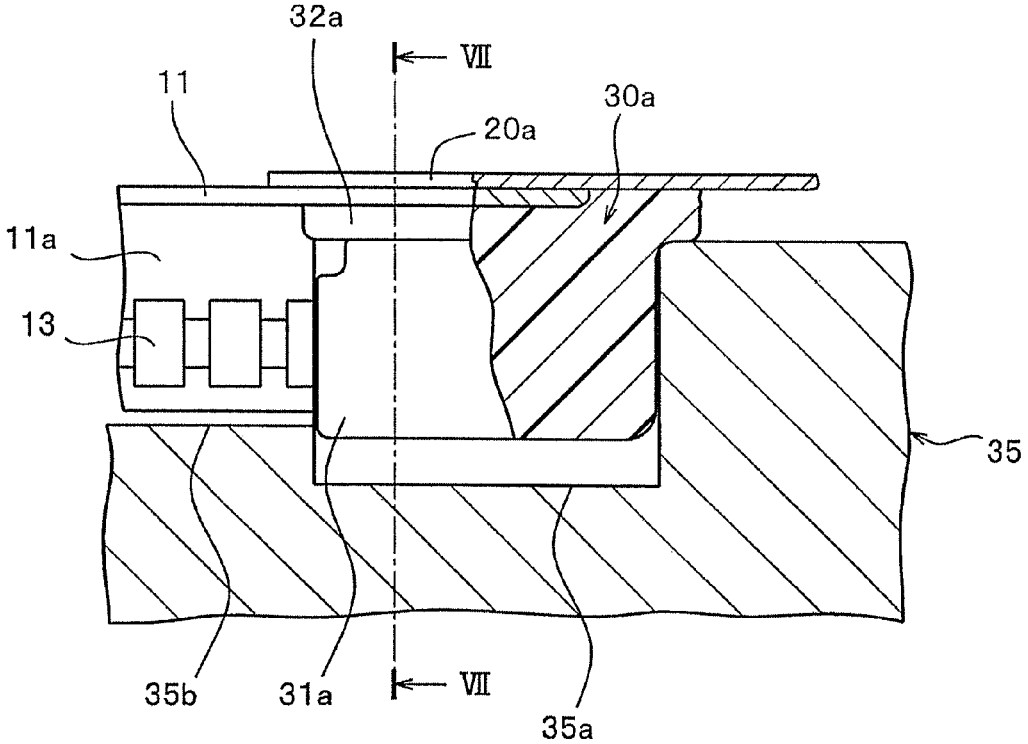
FIG. 6 is a diagram illustrating a state in which the injection molding of the first stopper is accommodated in the molding.

To the first and second accommodating hole portions 35*a*, 35*b* of the prepared first mold 35, as shown in FIG. 6 and FIG. 7, the first and second fastener stringers 10*a*, 10*b* are placed on the first mold 35 in the reversed upper and lower direction so as to accommodate the body portion 31 of the first stopper molding 30*a* and the element row 12 respectively. Further, the flat plate-shaped second mold 36 is overlapped on the first and second fastener stringers 10*a*, 10*b* placed on the first mold 35.

Figure 8:
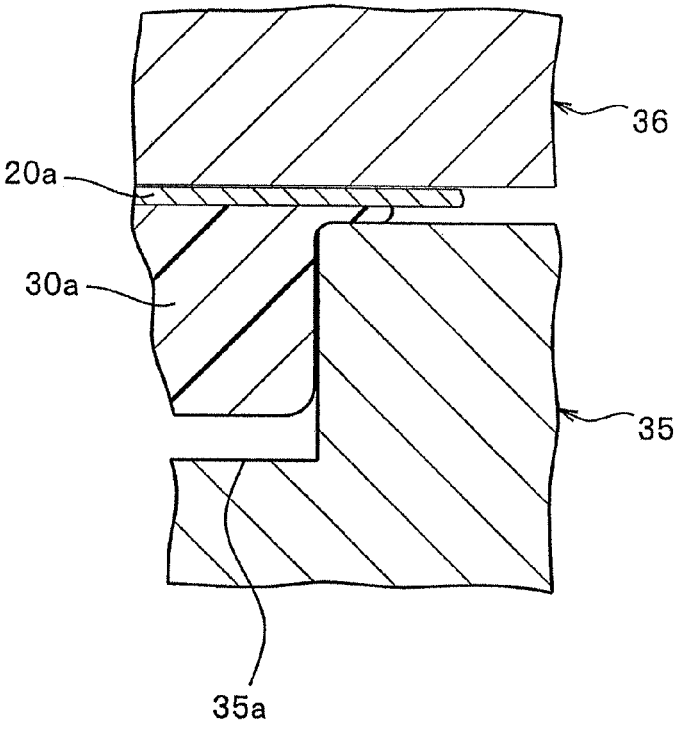
FIG. 8 is a cross-section view illustrating a state of the high-frequency wave adhesion by pressing a fin portion of the injection molding of the first stopper.

Then, as shown in FIG. 8, high-frequency wave adhesion is done by applying the high-frequency wave to the border portion of the fin portion 32*a* of the first stopper molding 30*a*, and the airtight and waterproof tape 11 and the first backing tape piece 20*a*, while pressing the fin portion 32*a* of the first stopper molding 30*a* towards the airtight and waterproof tape 11 and the first backing tape piece 20*a* by pressurizing the second mold 36 to the first mold 35.

At this time, the fin portion 32*a* of the first stopper molding 30*a* is adhered to the airtight and waterproof layer of the airtight and waterproof tape 11 and the airtight and waterproof layer of the first backing tape piece 20*a* while squashed in the tape front and back direction. By this, the first stopper 30 of present Embodiment 1 comprising the high-frequency wave adhesion portion 32 with an extremely thin thickness of 0.1 mm or less as described above is formed. Also in this case, the area near the high-frequency wave adhesion portion 32 of the body portion 31 of the first stopper 30 may also be adhered to the airtight and waterproof tape 11 and the first backing tape piece 20*a* for the high-frequency wave is applied.

By using the high-frequency wave adhesion like the above, for example even when the adhesion layer by the adhesive agent is not formed between the first stopper 30, and the airtight and waterproof tape 11 and the first backing tape piece 20*a*, the first stopper 30 can be strongly adhered to the airtight and waterproof tape 11 and the first backing tape piece 20*a* in a short period of time. Particularly in this case, the whole area including the forefront portion of the high-frequency wave adhesion portion 32 can be adhered to the airtight and waterproof tape 11 and the first backing tape piece 20*a* with certainty.

For this reason, the fixing strength of the first stopper 30 of present Embodiment 1 with respect to the airtight and waterproof tape 11 and the first backing tape piece 20*a* is significantly increased compared for example to the stopper in Patent Document 1 or Patent Document 2. Also, the time required to form the first stopper 30 is greatly shortened compared to the case of forming the stopper over the applied adhesion agent.

Further, the high-frequency wave adhesion portion 32 of the first stopper 30 can stably maintain high fixing strength for a long period of time, for it does not deteriorate over time for example like the adhesion layer. In addition, in the first stopper 30, since the upper surface of the high-frequency wave adhesion portion 32 and the upper surface of the airtight and waterproof tape 11 are formed flat respectively, and the upper surface of the high-frequency wave adhesion portion 32 and the upper surface of the first backing tape piece 20*a* are also formed flat respectively, the quality of appearance and the feel of the waterproof fastener 1 increases.

Note that, in the case of the adhesion of the first stopper 30 and the adhesion of the second stopper 40 to be described later, using an ultrasonic adhesion instead of the high-frequency wave adhesion can be considered. However, the ultrasonic adhesion carries an ultrasonic vibration to an object to be heated and generates friction heat for adhesion. For this reason, as described above, in the case where each airtight and waterproof layer of the airtight and waterproof tape 11 and the first backing tape piece 20*a*, or the first and second stoppers 30, 40 are configured from the thermoplastic elastomer, the vibration energy of the ultrasonic vibration is damped inside the thermoplastic elastomer, and may not generate enough friction heat required for adhesion. Therefore, in the present invention, the first and second stoppers 30,40 are adhered using the high-frequency wave adhesion which vibrates the molecules with a high-frequency wave (electromagnetic wave) energy.

After forming the first stopper 30 on the first and second fastener stringers 10*a*, 10*b* as described above, the slider 50 is slidably attached to the left and right element rows 12.

After, the second stopper 40 is formed on the first and second fastener stringers 10*a*, 10*b* so as to embed the forefront portion of the element row 12, and the triangular projecting portion 45 is formed on the second backing tape piece 20*b*.

In this case, the forming of the second stopper 40 can be done in the same manner as the forming of the first stopper 30 as described above. Also, the triangular projecting portion 45 is formed at the same time as the forming of the second stopper 40.

That is, firstly, the second stopper molding 40*a* as shown in FIG. 11 is injection molded so as to stride across the front end portion upper surface of the airtight and waterproof tape 11 and the upper surface of the second backing tape piece 20*b* using the thermoplastic elastomer. This second stopper molding 40*a* comprises the substantially cuboid-shape molding body portion 41*a* which embeds the front end portion of the element row 12, and the fin portion 42*a* which extends outward so as to surround the molding body portion 41*a* from the lower end portion of the molding body portion 41*a*.

In this case, the front end portion of the element row 12 is embedded inside the molding body portion 41*a* of the second stopper molding 40*a* in a separated state. Also, the fin portion 42*a* of the second stopper molding 40*a* extends outwards from the left and right side surface portion and the rear side surface portion, and both the left and right end portions of the front side surface portion of the molding body portion 41*a*.

Further, at the same time as injection molding the second stopper molding 40*a*, the projecting portion molding (not illustrated) of the projecting portion 45 is injection molded on the second backing tape piece 20*b* using the same material as that of the second stopper molding 40*a*. In this case, the projecting portion molding comprises a projecting portion main portion with a triangular cross-section, and a base end portion disposed between the projecting portion main portion and the second backing tape piece 20*b*.

After forming the above second stopper molding 40*a* and the projecting portion molding, the first and second fastener stringers 10*a*, 10*b* are placed in a upper and lower direction reverted position on the mold which comprises the accommodation hole portion of a predetermined shape. At this time, the molding body portion 41*a* of the second stopper molding 40*a* and the projecting portion main portion of the projecting portion molding are respectively accommodated in the accommodation hole portion of the mold.

Then, the high-frequency wave adhesion is done by applying the high-frequency wave while pressing the fin portion 32*a* of the second stopper molding 40*a* and the base end portion of the projecting portion molding. By this, as described above, the second stopper 40 of present Embodiment 1 in which the high-frequency wave adhesion portion 42 having the thickness of 0.1 mm or less is disposed at the periphery portion of the body portion 41, and the projecting portion 45 having a triangular cross-section are formed.

By forming the second stopper 40 using the high-frequency wave adhesion as described above, alike the case of the first stopper 30, the second stopper 40 can be strongly adhered to the airtight and waterproof tape 11 and the second backing tape piece 20*b* in a short period of time, and above that, the whole area including the forefront portion of the high-frequency wave adhesion portion 42 can be adhered with certainty. Further, the triangular projecting portion 45 can also be strongly adhered on the second backing tape piece 20*b* in a short period of time.

Note that, in the present invention, the order in forming the first stopper 30, the second stopper 40, and the triangular projecting portion 45 is not particularly limited. For example, the first stopper 30 may be formed after forming the second stopper 40 and the projecting portion 45, or, the first stopper 30, the second fastening 40, and the projecting portion 45 may be formed at the same time. Further, the time and method in which the slider 50 is attached to the left and right element rows 12 are also not particularly limited.

By using the above described method, the waterproof fastener 1 of present Embodiment 1 as shown in FIG. 1 is manufactured. In the waterproof fastener 1 obtained in the above method, the first and second stoppers 30, 40 are adhered and integrated extremely strongly to the airtight and waterproof tape 11 and the second backing tape piece 20*b* using the high-frequency wave adhesion.

Furthermore, the high-frequency wave adhesion portions 32, 42 of the first and second stoppers 30, 40 are adhered with certainty with high fixing strength even to their forefront portions, and are configured at a extremely thin thickness of 0.1 mm or less. For this reason, when the waterproof fastener 1 is bent at a periphery portion of the first and second stoppers 30, 40, the high-wave adhesion portions 32, 42 of the first and second stoppers 30, 40 can easily be bent according to the airtight and waterproof tape 11.

Accordingly, in the waterproof fastener 1 of present Embodiment 1, the first and second stoppers 30, 40 (particularly, the high-frequency wave adhesion portions 32, 42 of the first and second stoppers 30, 40) can be effectively prevented from detaching, and airtightness and waterproof property of the waterproof fastener 1 can be stably maintained for a long period of time.

Figure 12:
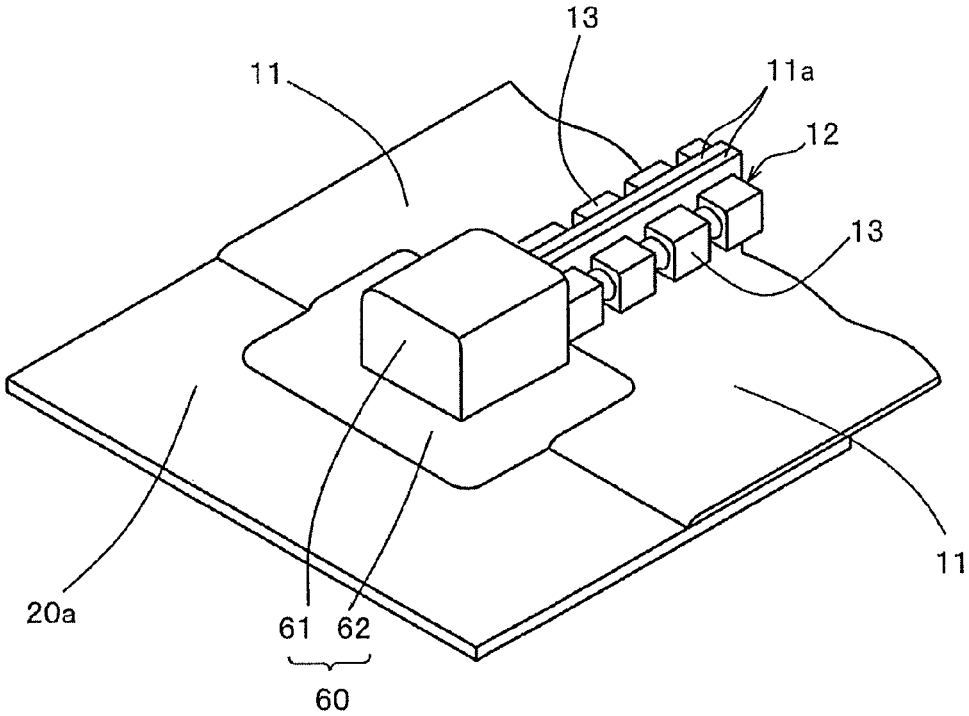
FIG. 12 is an enlarged perspective view of the first stopper according to a modified embodiment.

Note that, in the present invention, the size (extension length) of the high-frequency wave adhesion portions 32, 42 of the first and second stoppers 30, 40 are not particularly limited, and can be set arbitrarily. For example, as shown in the modified embodiment in FIG. 12, the first stopper 60 can be formed to comprise the cuboid-shape body portion 61 and the high-frequency wave adhesion portion 62 with a long width (long extension length).

Figure 13:
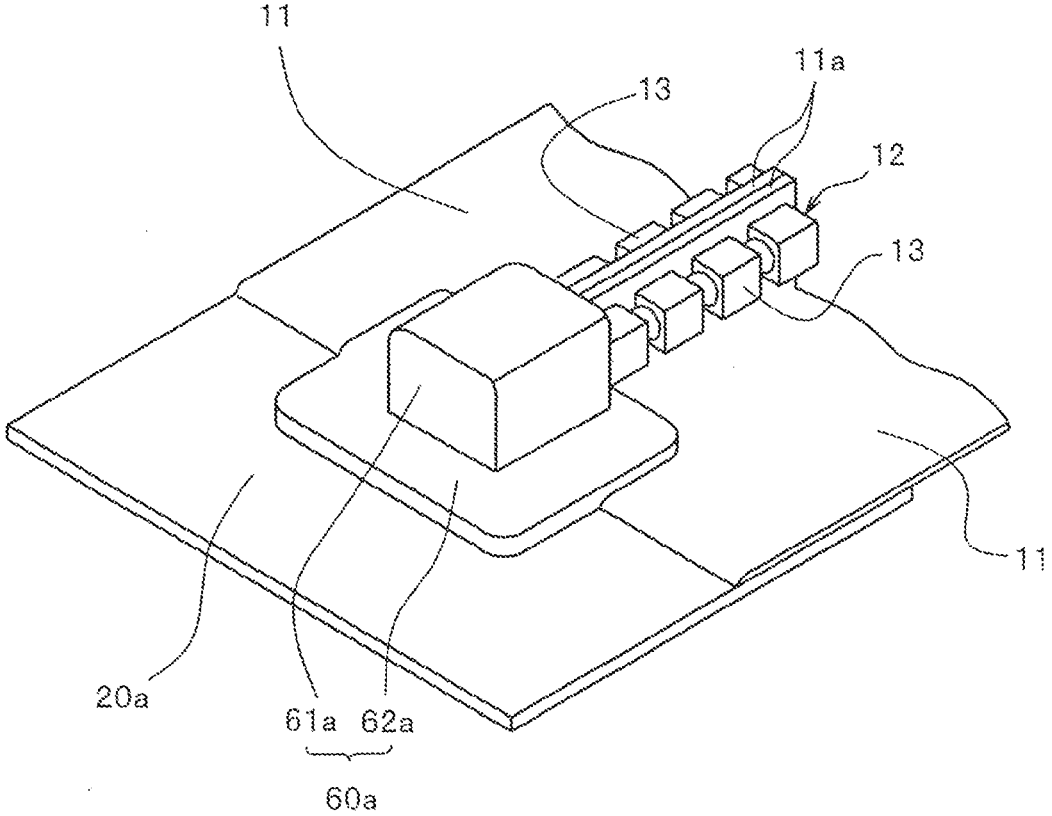
FIG. 13 is a perspective view illustrating the injection molding of the first stopper according to the modified embodiment.
Figure 14:
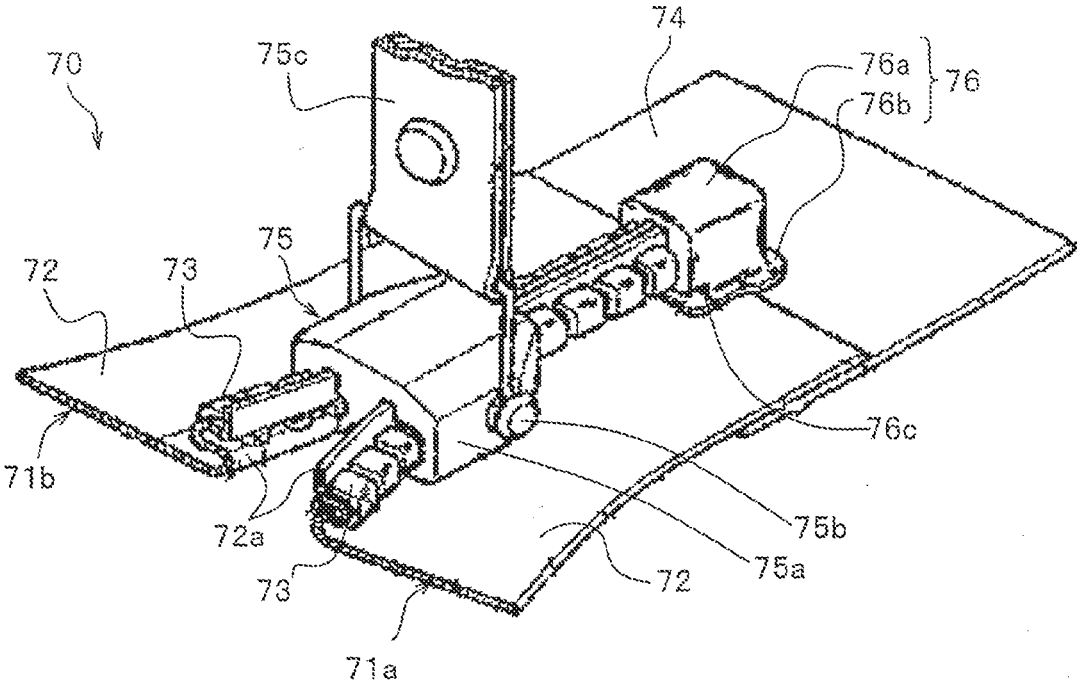
FIG. 14 PRIOR ART
FIG. 14 is a perspective view illustrating a conventional airtight and waterproof slide fastener.
Figure 15:
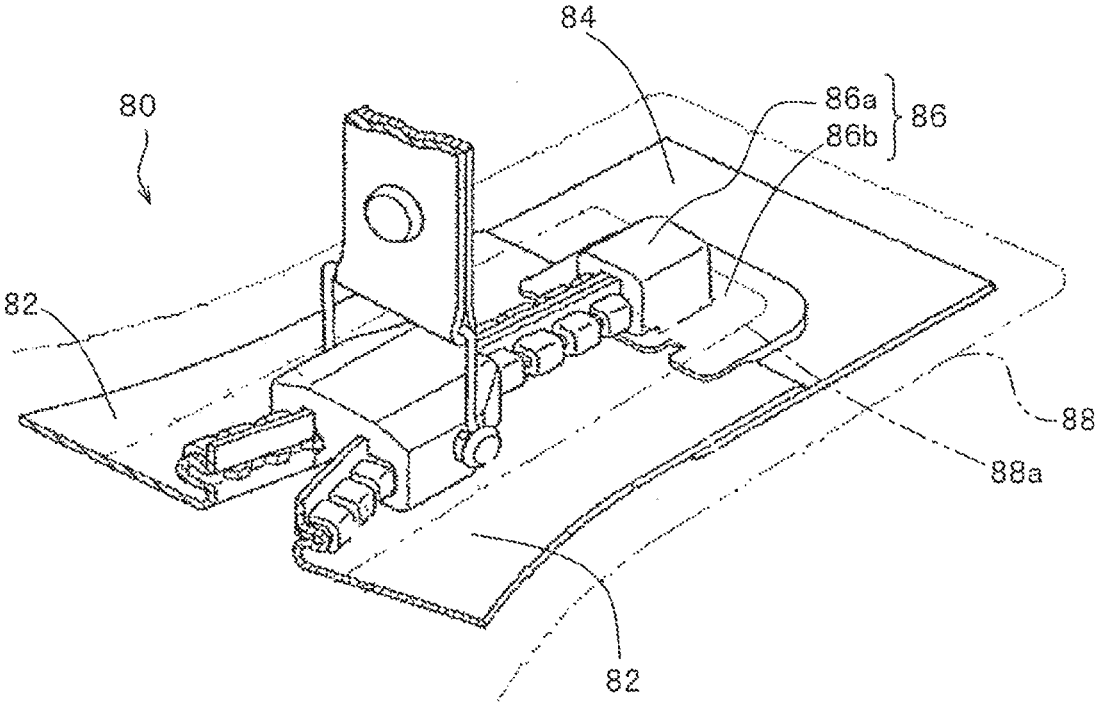
FIG. 15 PRIOR ART
FIG. 15 is a perspective view illustrating a different conventional airtight and waterproof slide fastener.

In the case of forming the first stopper 60 according to the above modified embodiment, alike the above mentioned Embodiment 1, firstly, the first stopper molding 60*a* comprising a molding body portion 61*a* and the fin portion 62*a* with large extension length as shown in FIG. 13 are injection molded so as to stride across the airtight and waterproof tape 11 and the first backing tape piece 20*a* using the thermoplastic elastomer. After, the high-frequency wave adhesion is done by applying the high-frequency wave while pressing the fin portion 62*a* of the first stopper molding 60*a*. By this, the first stopper 60 comprising the high-frequency wave adhesion portion 62 with long extension length can be strongly adhered and integrated to the airtight and waterproof tape 11 and the second backing tape piece 20*b*.

DESCRIPTION OF REFERENCE NUMERALS

1 Airtight and waterproof slide fastener (waterproof fastener)
5 Product to which a fastener is attached
5*a* Opening portion
10*a* First fastener stringer
10*b* Second fastener stringer
11 Airtight and waterproof tape
11*a* Tape side edge portion
12 Element row
13 Fastener element

14 Coupling element
14*a* Rectangular column portion
14*b* Coupling head portion
14*c* Flange portion
15 Clamp element
15*a* Sandwiching piece
15*b* Connecting portion
15*c* Lip portion (protruding portion)
20 Backing tape piece
20*a* First backing tape piece
20*b* Second backing tape piece
30 First stopper
30*a* First Stopper molding (injection molding)
31 Body portion
31*a* Molding body portion
32 High-frequency wave adhesion portion
32*a* Fin portion
35 First mold
35*a* First accommodating hole portion
35*b* Second accommodating hole portion
36 Second mold
40 Second stopper
40*a* Second stopper molding (injection molding)
42 Body portion
41*a* Molding body portion
42 High-frequency wave adhesion portion
42*a* Fin portion
45 Projecting portion
50 Slider
51 Slider body
51*a* Tab maintaining portion
52 Tab
60 First stopper
60*a* First stopper molding
61 Body portion
61*a* Molding body portion
62 High-frequency wave adhesion portion
62*a* Fin portion

The invention claimed is:

1. A method for forming a stop wherein a thermoplastic elastomer stopper which is disposed on at least one end portion side of an element row is fixed to stride across an airtight and waterproof tape and a backing tape piece, with respect to a pair of first and second fastener stringers wherein a plurality of fastener elements are attached to facing tape side edge portions of a pair of the airtight and waterproof tapes provided with an airtight and waterproof layer on at least one tape surface, wherein each fastener element is configured by holding together the tape side edge portion and a coupling element inside a clamp element with a U-shaped cross-section, and wherein the backing tape piece is fixed on at least one end portion side of the element row to stride across the pair of the airtight and waterproof tapes, wherein it comprises:

injection molding a stopper molding which comprises a molding body portion which embeds an end portion of the element row, and a thin fin portion which extends outward from a periphery portion of at least one portion of the molding body portion on at least one end portion side of the element row;

providing a first mold and a second mold;

providing a first accommodating hole portion and a second accommodating hole portion shallower than the first accommodating hole portion on an upper surface of the first mold adjacent to one another;

wherein a depth of the first accommodating hole portion is larger than a thickness of the at least one portion of the molding body portion excluding a thickness of the thin fin portion;

accommodating the molding body portion of the stopper molding in the first accommodating hole portion;

accommodating the element row in the second accommodating hole portion;

making the first mold and the second mold close relatively and pressurizing a space between the molds;

and adhesion integrating the stopper to the airtight and waterproof tape and the backing tape piece by adhering the fin portion of the stopper molding by a high-frequency wave while pressing it to the airtight and waterproof tape and the backing tape piece, and forming a high-frequency wave adhesion portion which is thinner than the fin portion.

2. The method for forming the stop according to claim 1, comprising continuously providing the fin portion on the periphery portion excluding one portion area of the side surface portion of the element row side of the molding body portion.

3. The method for forming the stop according to claim 1, comprising making a surface of the high-frequency wave adhesion portion flat with respect to a tape surface of the airtight and waterproof tape.

4. The method for forming the stop according to claim 1, comprising making a dimension in a tape front and back direction of the high-frequency wave adhesion portion with respect to the tape surface of the airtight and waterproof tape 0.1 mm or less.

* * * * *